US006032728A

United States Patent [19]

Ross et al.

[11] Patent Number: 6,032,728

[45] Date of Patent: Mar. 7, 2000

[54] VARIABLE PITCH HEAT EXCHANGER

[75] Inventors: Gary R. Ross, Ann Arbor, Mich.; James R. Bacoccini, Toledo, Ohio

[73] Assignee: Livernois Research & Development Co., Dearborn, Mich.

[21] Appl. No.: 09/190,327

[22] Filed: Nov. 12, 1998

[51] Int. Cl.[7] ..... F28F 9/04

[52] U.S. Cl. ..... 165/153; 165/76; 165/173

[58] Field of Search ..... 165/153, 76, 173

[56] References Cited

U.S. PATENT DOCUMENTS

| | | | |
|---|---|---|---|
| 1,993,390 | 3/1935 | Voss . | |
| 2,573,161 | 10/1951 | Tadewald | 165/153 |
| 2,899,177 | 8/1959 | Harris et al. | 165/153 |
| 4,470,452 | 9/1984 | Rhodes . | |
| 4,615,385 | 10/1986 | Saperstein et al. . | |
| 4,825,941 | 5/1989 | Hoshino et al. . | |
| 4,960,169 | 10/1990 | Granetzke . | |
| 5,052,478 | 10/1991 | Nakajima et al. . | |
| 5,193,613 | 3/1993 | Wallis . | |

FOREIGN PATENT DOCUMENTS

| | | |
|---|---|---|
| 7229162 | 10/1973 | Germany . |

*Primary Examiner*—Allen Flanigan
*Attorney, Agent, or Firm*—Brook & Kushman P.C.

[57] ABSTRACT

A heat exchanger (10) having a pair of spatially separated manifolds (12 and 14) interconnected by a plurality of transverse tubes (16). The ends of the tubes are attached to a plurality of manifold inserts (20) slidably received in the manifolds. The lengths of the individual manifold inserts may be controlled to adjust the pitch and the number of the transverse tubes. The heat exchanger configuration is ideally suited for fabricating low production runs and prototype heat exchangers.

12 Claims, 5 Drawing Sheets

Fig. 10
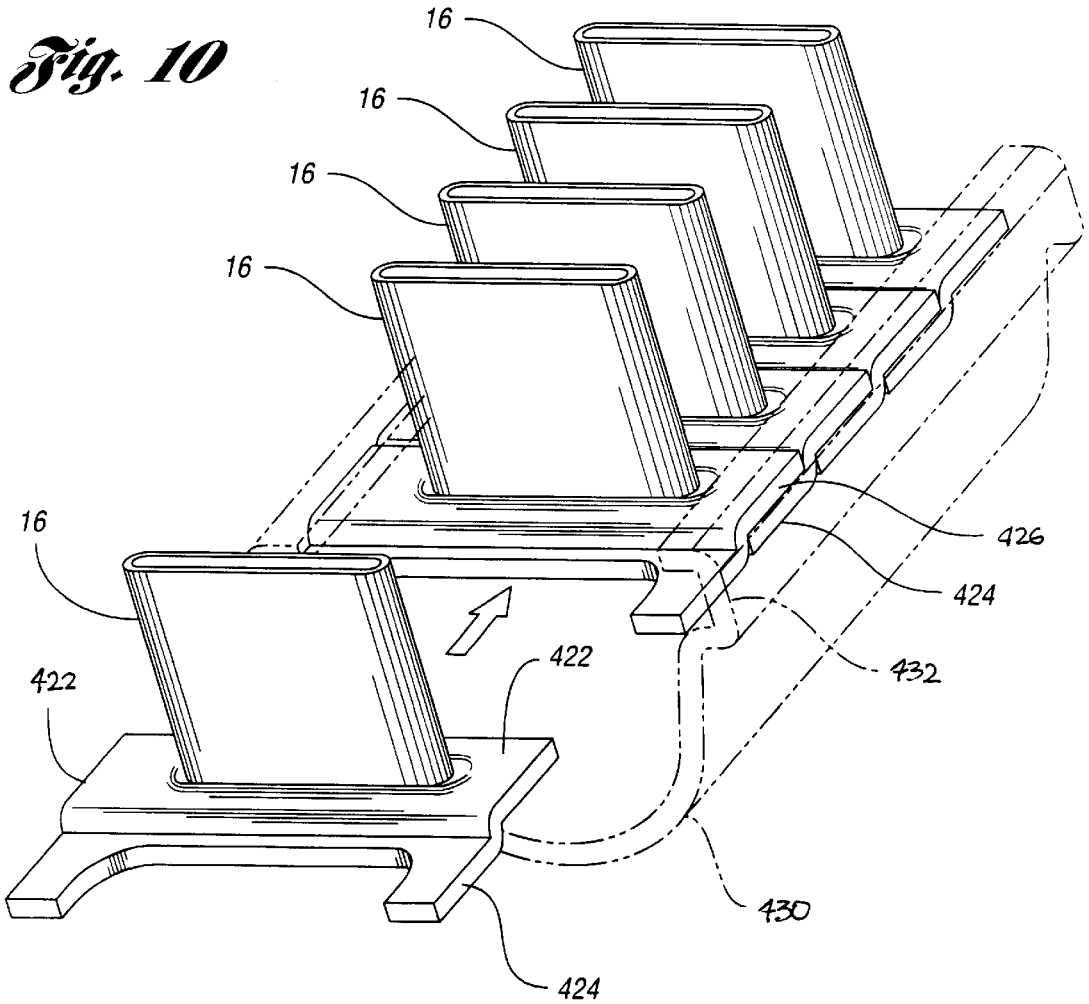
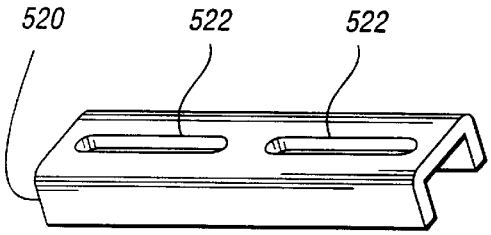
Fig. 11
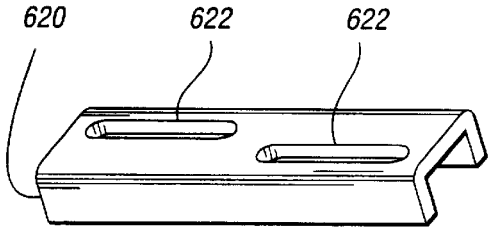
Fig. 12

VARIABLE PITCH HEAT EXCHANGER

TECHNICAL FIELD

The invention is related to the field of heat exchangers and, in particular, to a heat exchanger design in which it is easy to vary the pitch (or spacing) of the transverse tubes.

BACKGROUND ART

Heat exchangers of the type having a pair of spatially separated headers or manifolds interconnected by a plurality of transverse fluid transfer tubes are well known in the art. Corrugated fins are conventionally inserted between adjacent transverse tubes to facilitate the energy transfer between the fluid flowing through the tubes and an external atmosphere such as air. Heat exchangers, such as taught by Nakajima et al. in U.S. Pat. No. 5,052,478; Granetzke in U.S. Pat. No. 4,960,169; Wallis in U.S. Pat. No. 5,193,613; and Neshina et al. in U.S. Pat. No. 4,825,941 embody unitary headers. These headers are complex and require costly tooling to fabricate and in most instances changes are difficult and relatively expensive to make. In particular, if a change in the pitch (spacing) between the transverse tubes is desired, a whole new set of tooling is generally required. These heat exchanger configurations are not susceptible to making changes without incurring expensive tooling costs. Against this background there arises a need for a heat exchanger design in which the pitch and the number of tubes can readily be changed to accommodate prototype and/or low volume production.

SUMMARY OF THE INVENTION

A heat exchanger is disclosed having a pair of spatially separated manifolds interconnected by a plurality of transverse tubes. A plurality of manifold inserts are slidably received in the manifolds and provide a plurality of tube apertures in which the transverse tubes are received and sealed. The length of the manifold inserts is selected to provide the desired pitch or spacing between adjacent tubes.

One object of the invention is that the pitch can readily be changed to accomplish the desired heat transfer characteristics.

Another object of the invention is that it is well adapted to prototype or small volume production without costly tooling.

Still another object of the invention is that it is easy to assemble.

Yet another object of the invention is that it is easy to change the number of tubes and the size of the heat exchanger.

Still another object of the invention is that the disclosed heat exchanger may be used for cooling (radiator), oil coolers, charge air coolers, evaporators, condensers, and any other type of heat exchanger known in the art.

These and other objects of the invention will become more apparent from a reading of the specification in conjunction with the drawings.

DESCRIPTION OF THE DRAWINGS

FIG. 10 is a partial exploded view of a heat exchanger incorporating the manifold insert shown in FIG. 9;

FIG. 11 is a perspective of a manifold insert for multiple rows of tubes; and FIG. 12 is a perspective of a manifold insert for staggered rows of tubes.

DETAILED DESCRIPTION OF THE PREFERRED EMBODIMENT

Figure 1:
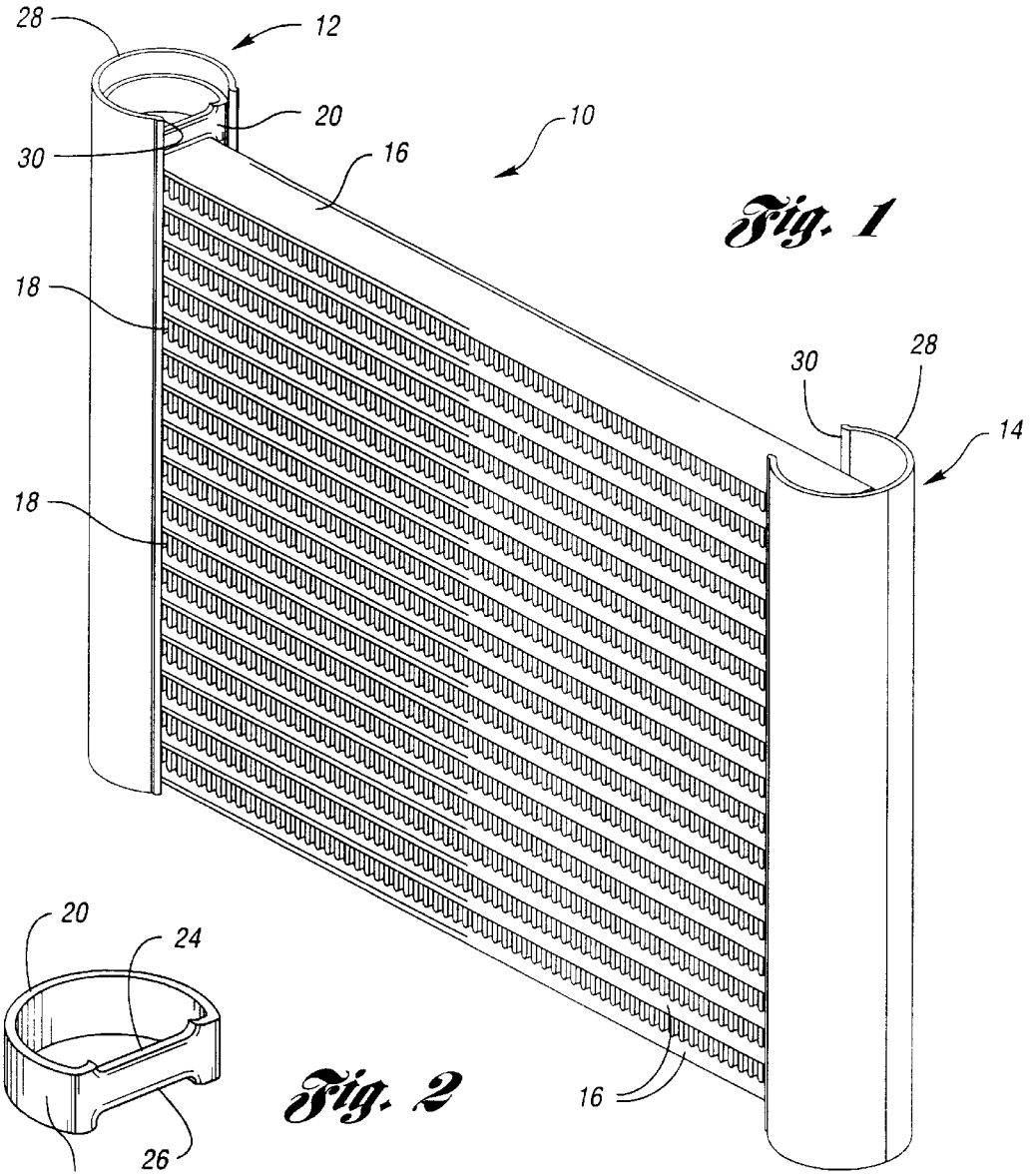
FIG. 1 is a perspective view of a heat exchanger according to the invention.

FIG. 1 shows a partially completed assembly of an adjustable pitch heat exchanger 10 of the type disclosed by this invention. The heat exchanger 10 has a pair of spatially separated manifolds or headers 12 and 14 interconnected by a plurality of fluid transverse tubes 16. The fluid transfer tubes are attached to the manifolds 12 and 14 by manifold inserts 20 as shall be described hereinafter. Corrugated fins 18 are inserted between and fused to the fluid transverse tubes 16 to enhance the heat exchange between a fluid flowing in the tubes 16 and an external atmosphere such as air. Once assembled, the manifolds 12 and 14, the tubes 16, fins 18 and inserts 20 are fused to each other to form an integral fluid-tight assembly. A heat exchanger 10 embodying the assembly shown in FIG. 1 may be used as a radiator, oil cooler, charge air cooler, condenser, evaporator, or any other type of heat exchange application.

Figure 2:
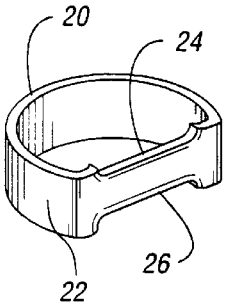
FIG. 2 is a perspective view of a first embodiment of a manifold insert.

A first embodiment of the manifold insert 20 is shown in FIG. 2. In this first embodiment, each manifold insert 20 is a cylindrical element 22 having contoured recesses 24 and 26 provided at opposite end faces thereof. These recesses 24 and 26 are contoured to mate with the external contour of the tubes 16. In the example shown in FIG. 1, the tubes 16 have an oblong cross-section, however, the tubes may have a circular cross-section or any other shape known in the art. The recesses 24 and 26 may be machined, stamped, coined, or made by any other method known in the art. The length or height of each insert element 22 is selectable to adjust the pitch or spacing between the adjacent tubes 16 as desired.

The manifolds 12 and 14 are made from an elongated hollow member such as cylindrical tubes 28 having longitudinal slots 30 provided along the length thereof as shown in FIG. 1. Alternatively, the elongated hollow member 28 may have a square, hexagonal or oval cross-section. The inserts 20 are slidably received in the tubes 28. The width of the longitudinal slots 30 is selected to be greater than the width of the tubes 16.

The tubes 16, manifolds 12 and 14, manifold inserts 20 and fins 18 are preferably made from an aluminum alloy clad with a solder or brazing material commercially available as "ALCAN" or "ALUMAX". The thickness of the cladding material is approximately 5 to 10% of the total thickness of the material being used and has a melting temperature significantly less than aluminum alloy.

Figure 4:
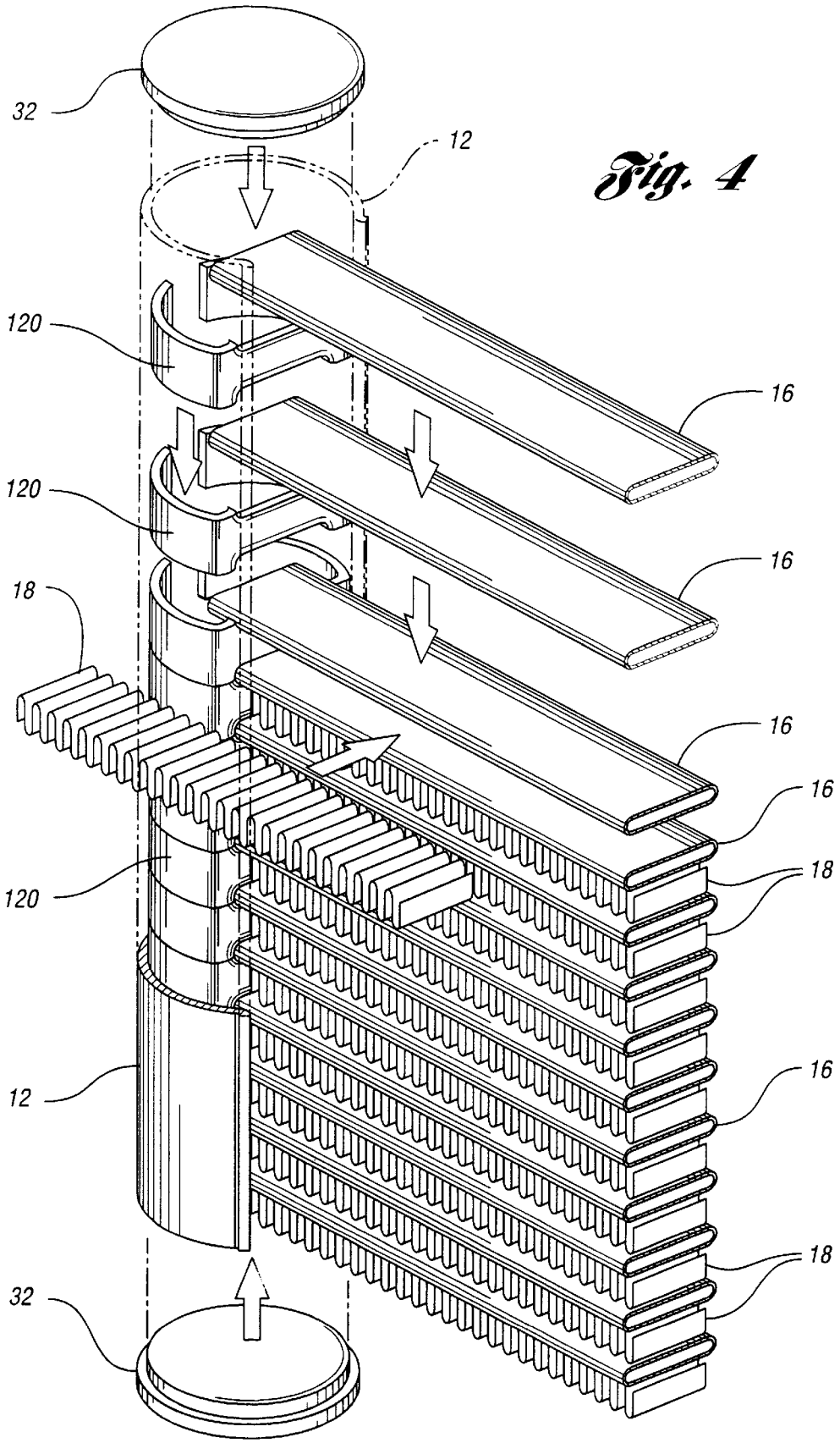
FIG. 4 is a partially exploded view of a heat exchanger using "C" shaped manifold inserts.

In assembly, the manifold inserts 20 are received into each manifold 12 and 14 in an alternating arrangement with the tubes 16 until the desired number of tubes are inserted. The recesses 24 are omitted on the external faces of the end inserts 20 to provide a flat sealing surface. End caps 32 may be attached to the opposite ends of each manifold as shown in FIG. 4 to complete the assembly of the heat exchanger 10. Inlet and outlet connectors (not shown) may be added to the manifolds 12 and 14 as is known in the art.

The primary advantages of the heat exchanger as described above is that it permits a rapid and inexpensive fabrication of low production or prototype heat exchanger cores 10. It permits the use of a different number of tubes and different spacings or pitch between the tubes without the need to use expensive dies and complex labor-intensive assembly.

Figure 3:
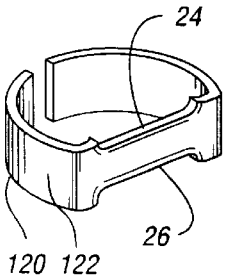
FIG. 3 is a perspective view of a second embodiment of the insert.
Figure 3A:
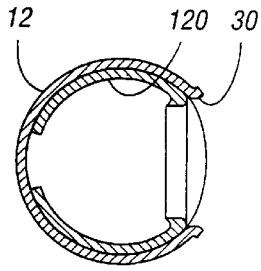
FIGS. 3*a*–3*c* are cross-sectional views showing alternate configurations of the "C" shaped embodiment of the manifold insert shown in FIG. 3.
Figure 3B:
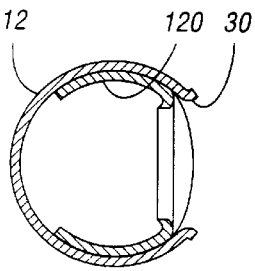
Figure 3C:
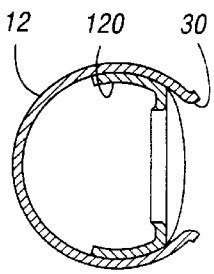

An alternate embodiment 120 of the manifold insert 20 is shown in FIG. 3. In this embodiment, the insert 120 is a "C" shaped element 122 having a selectable length. The recesses 24 and 26 are provided on the opposite faces of the "C" shaped element 122 opposite the open portion of the "C" as shown. The external diameter of the insert 120 is selected to be an interference fit into the manifolds 12 and 14. The "C" shaped configuration of the insert 120 permits it to be elastically compressed, eliminating a binding condition as it is inserted into the manifolds 12 and 14. The angular or arcuate width of the opening portion of the "C" shaped element may be any angle less than 160°, as shown in FIG. 3*c*, so that it will be self-centering within the manifold. Further, the location of the recesses 24 and 26 may vary from adjacent to the slot 30 in the manifolds 12 and 14 as shown in FIG. 3*a* to a location displaced inwardly as shown in FIG. 3*c*. FIG. 3*b* shows the open portion of the "C" shaped segment and the location of the recess 24 relative to the slot 30, being intermediate the positions shown in FIGS. 3*a* and 3*c*.

FIG. 4 shows the assembly procedure of a heat exchanger 10 according to the invention using inserts 120. Again, the inserts 120 and the tubes 16 are received in the manifolds 12 and 14 in an alternating sequence. The assembly is completed by inserting corrugated fins 18 between adjacent tubes 16 and the placing of end caps 32 at the opposite ends of the manifolds 12 and 14.

Figure 5:
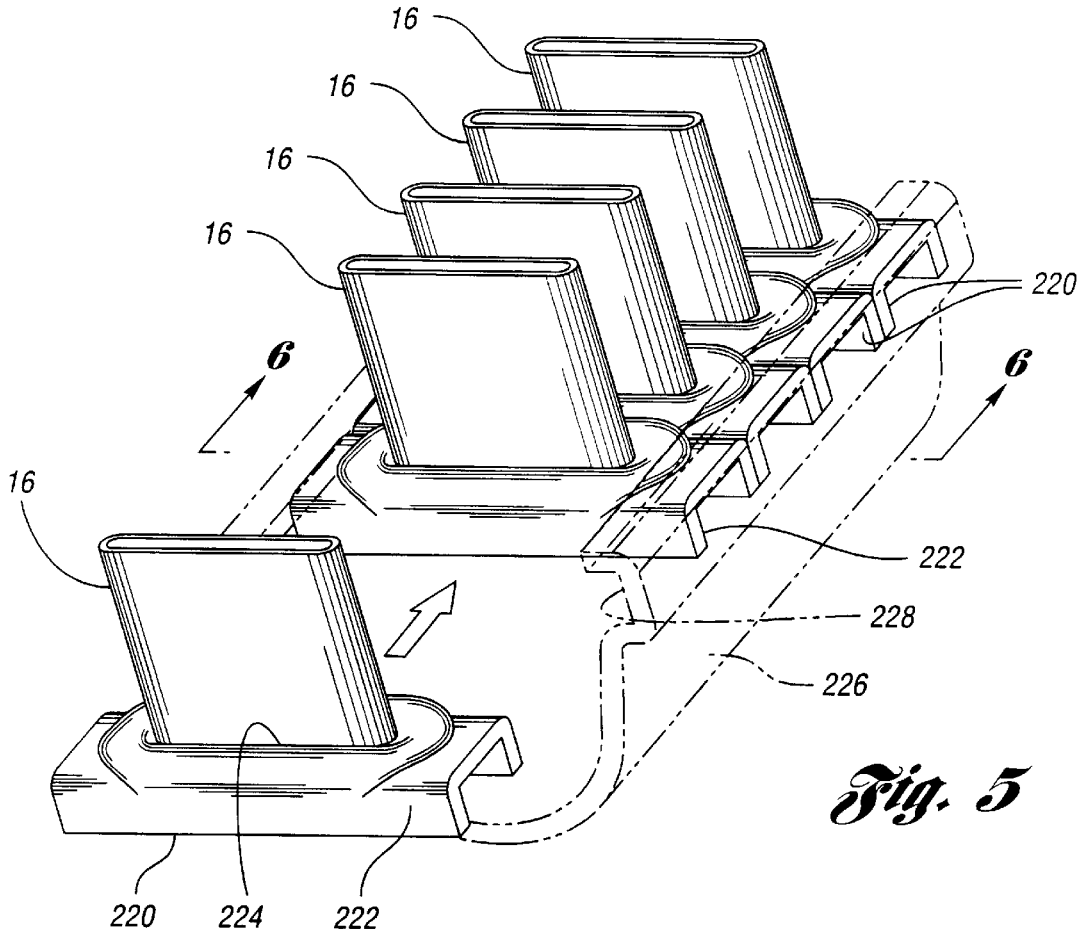
FIG. 5 is a partially exploded view of a heat exchanger using a third embodiment of the manifold inserts.
Figure 6:
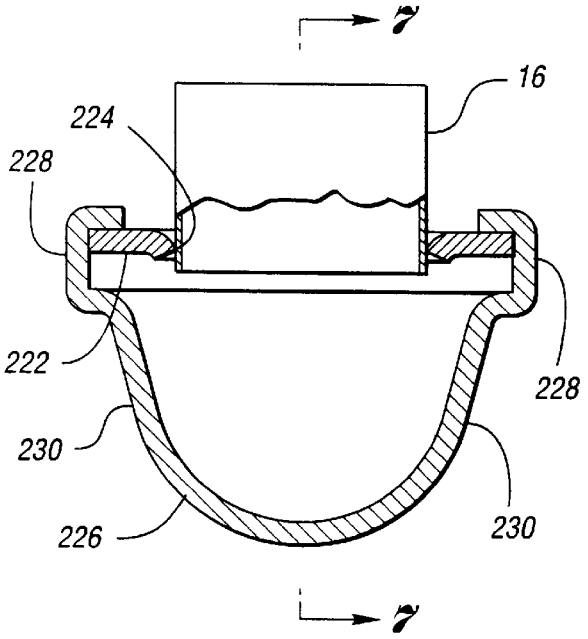
FIG. 6 is a cross-sectional end view of the heat exchanger shown in FIG. 5.
Figure 7:
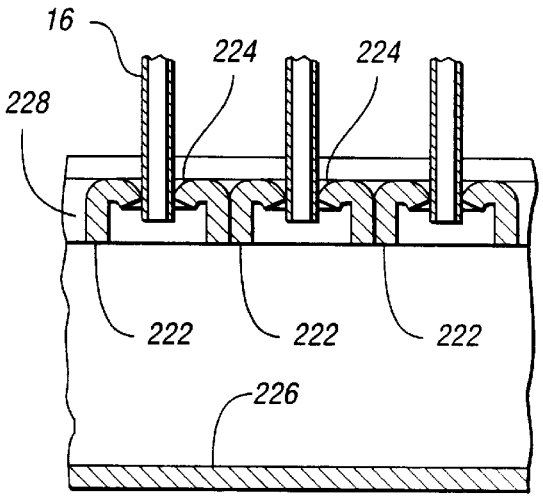
FIG. 7 is a partial cross-sectional side view of the heat exchanger shown in FIG. 5.

A still alternate embodiment 220 of the inserts 20 is shown in FIGS. 5, 6 and 7. In this embodiment, each insert 220 consists of a rectangular "U" shaped plate 222 having a punched or coined aperture 224 sized to receive the ends of the tubes 16 with an interference fit. The manifolds 12 and 14 consist of a "U" shaped member 226 having inwardly-facing rectangular channels 228 provided at the terminal ends at the ends of the legs 230 of the "U" shaped member 226. The inserts 220 are slidably received in the rectangular channels 228 as shown. In assembly, the inserts are slidably received into the rectangular channels 228 and the tubes 16 are pressed into the apertures 224. After assembly, the assembled heat exchanger is heated to fuse or braze the entire assembly as an integral fluid tight assembly.

Figure 8:
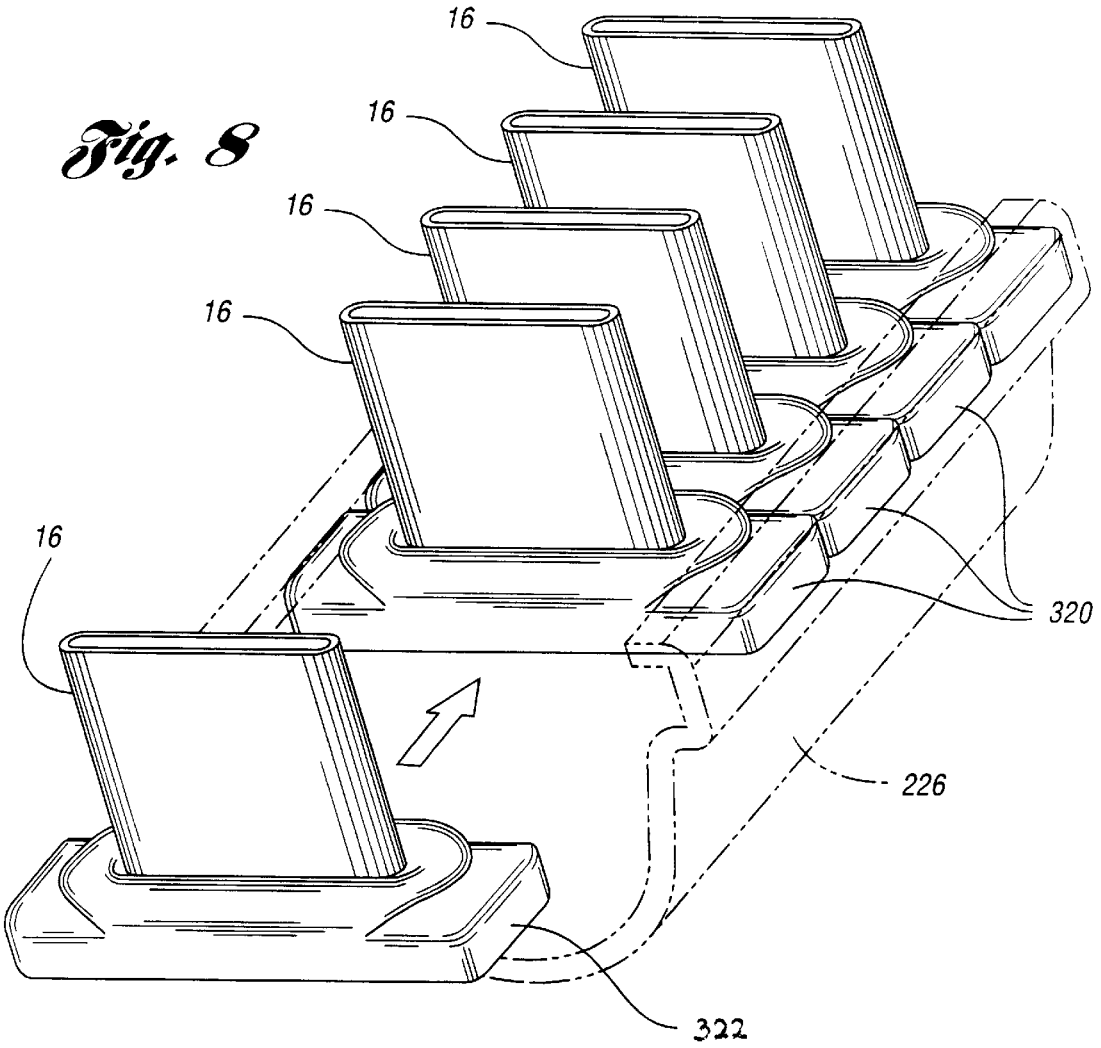
FIG. 8 is a partial exploded view of a heat exchanger using a fourth embodiment of the manifold insert.

A still alternate embodiment 320 of the insert 20 compatible with the "U" shaped manifold 226 is shown on FIG. 8. In this embodiment, the inserts 320 have the ends closed to form an open faced rectangular box 322 having a tube aperture provided therethrough. The assembly of the heat exchanger is fabricated in the same manner as the heat exchanger embodiment shown on FIG. 5.

Figure 9:
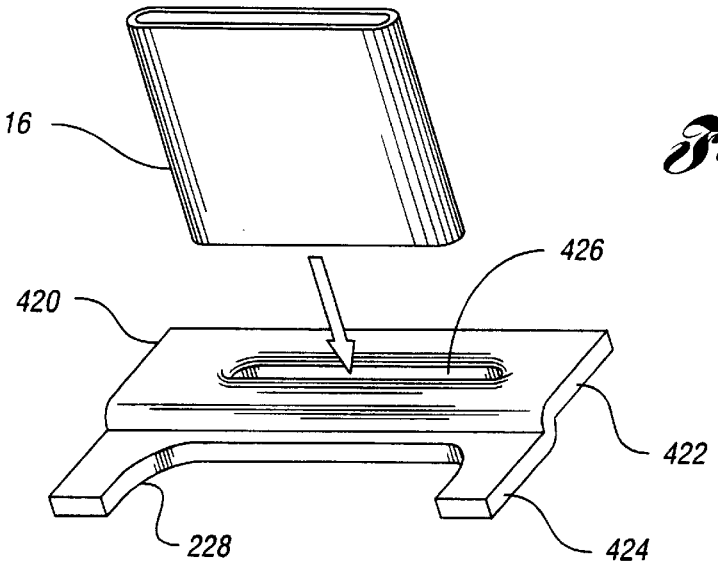
FIG. 9 is a perspective of a fifth embodiment of the manifold insert.

Another embodiment 420 of the insert 20 is shown in FIGS. 9–10. In this embodiment, the insert consists of stepped plate having a rectangular upper portion 422 and a contiguous rectangular lower portion 424. The upper portion 422 has a centrally provided tube aperture 426 sized to receive an end of the tube 16 with an interference fit. The lower portion 224 has a tube clearance recess 428 provided therein.

In assembly, the inserts 420 are inserted into the rectangular channels 432 provided at the open end of the manifold 430. The manifold 430 is comparable to the manifold discussed relative to FIGS. 5 and 6 having rectangular channels 228 provided at the terminal ends of the legs 230 of a "U" shaped member 226. In the assembled position, the upper portions 422 of the inserts 420 overlap the lower portions 424 of an adjacent insert 420 as shown in FIG. 10. This embodiment of the insert 420 is suitably adapted for heat exchangers having substantial internal to external pressure differences because it provides increased sealing areas between adjacent inserts and the manifolds.

It is recognized that the invention is not limited to heat exchangers having a single row of tubes. As illustrated in FIG. 11, each insert, such as insert 520, may have two or more offset apertures 522 receiving at least a second row of tubes 16. These additional rows of tubes may be in line with each other as shown on FIG. 11 or may be staggered as shown in FIG. 12. In FIG. 12, the offset tube apertures 622 of the insert 620 are staggered relative to each other so that the tubes in the second or subsequent rows lie in between the tubes in the preceding row of tubes.

Having disclosed various embodiments of the invention, it is recognized that others skilled in the art may conceive additional embodiment and improvements within the scope of the invention as set forth in the appended claims.

What is claimed is:

1. An adjustable pitch heat exchanger comprising:

a pair of spatially separated manifolds, each manifold in said pair having an internal curved surface, and having a facing longitudinal opening;

a plurality of manifold inserts that are at least partially conformable with the internal curved surface and that are sealingly attachable to one of said pair of spatially separated manifolds, juxtaposition of adjacent inserts providing a plurality of tube apertures defined between adjacent inserts aligned with said longitudinal openings;

a plurality of tubes extending transverse to said spatially separated manifolds, one end of each of said plurality of tubes being received in a respective one of said tube apertures provided by said inserts attached to one of said pair of spatially separated manifolds and sealed thereto, the other end of each tube being received in a respective one said tube apertures provided by said inserts attached to the other of said pair of spatially separated manifolds; and wherein the length of each of said inserts being selectable to produce a desired pitch of said tubes.

2. The heat exchanger of claim 1 further comprising a fin sealed between adjacent tubes.

3. The heat exchanger of claim 1 further comprising a seal for sealing opposite ends of said pair of spatially separated manifolds.

4. The heat exchanger of claim 1 wherein each of said manifolds is an elongated hollow member having a linear slot forming said openings, each of said plurality of inserts comprising an element sized to be received in said elongated member, said plurality of inserts having end faces and having at least one recess provided in at least one of said end faces, said at least one recess in conjunction with an adjacent insert forming said tube aperture.

5. An adjustable pitch heat exchanger comprising:

a pair of spatially separated manifolds, each manifold in said pair having a longitudinal opening;

a plurality of manifold inserts sealingly attachable to one of said pair of spatially separated manifolds, juxtaposition of adjacent inserts providing a plurality of tube apertures defined between adjacent inserts aligned with said longitudinal openings;

a plurality of tubes extending transverse to said spatially separated manifolds, one end of each of said plurality of tubes being received in a respective one of said tube apertures provided by said inserts attached to one of said pair of spatially separated manifolds and sealed thereto, the other end of each tube being received in a respective one said tube apertures provided by said inserts attached to the other of said pair of spatially separated manifolds;

wherein the length of each of said inserts is selectable to produce a desired pitch of said tubes, and wherein each of said manifolds is a cylindrical member having a linear slot forming said longitudinal opening, each of said plurality of inserts comprising a cylindrical element sized to be received in said cylindrical member, said cylindrical elements having end faces and having at least one recess provided in at least one of said end faces, said recess in conjunction with an adjacent insert forming said tube aperture.

6. The heat exchanger of claim 1 wherein each manifold is a cylinder having a linear slot forming said longitudinal opening, each insert of said plurality of inserts is a "C" shaped member having a recess provided in at least one end surface which forms said tube opening with a corresponding recess provided in an adjacent insert.

7. The heat exchanger of claim 6 wherein selected ones of said inserts have recesses provided in opposite end surfaces thereof forming said tube apertures at both ends with like recesses of adjacent inserts.

8. The heat exchanger of claim 6 wherein said "C" shaped members have an angular open section opposite said recess, said angular open section ranging angularly from zero degrees to less than 160°.

9. The heat exchanger of claim 7 further including corrugated inserts between adjacent tubes.

10. The heat exchanger of claim 2 wherein each insert has at least two apertures receiving said tubes to form at least two rows of tubes.

11. The heat exchanger of claim 10 wherein said at least two rows of tubes are in line with each other.

12. The heat exchanger of claim 10 wherein said at least two rows of tubes are staggered relative to each other.

* * * * *